US005931741A

United States Patent [19]

Fenton, Jr.

[11] Patent Number: 5,931,741

[45] Date of Patent: Aug. 3, 1999

[54] HOSEL-LESS GOLF CLUB WITH A SINGLE BENT SHAFT

[76] Inventor: Francis A. Fenton, Jr., 4667 Country Manor Dr., Sarasota, Fla. 34233

[21] Appl. No.: 08/890,411

[22] Filed: Jul. 9, 1997

[51] Int. Cl.[6] ..... A63B 53/02

[52] U.S. Cl. ..... 473/305; 473/314

[58] Field of Search ..... 473/305, 306, 473/307, 308, 309, 310, 311, 312, 313, 314

[56] References Cited

U.S. PATENT DOCUMENTS

| | | | |
|---|---|---|---|
| 669,864 | 3/1901 | Simpson | 473/314 |
| 1,705,250 | 3/1929 | Hinks | 473/313 |
| 1,889,743 | 12/1932 | Buhrke et al. | 473/312 |
| 2,820,638 | 1/1958 | Morrison | 473/313 |
| 3,539,184 | 11/1970 | Koorland | 473/314 |
| 3,860,244 | 1/1975 | Cosby | 473/314 |
| 3,967,826 | 7/1976 | Judice | 473/313 |
| 3,985,363 | 10/1976 | Jepson et al. | 473/309 |
| 4,650,191 | 3/1987 | Mills | 473/314 |
| 5,688,187 | 11/1997 | Duncan | 473/314 |

FOREIGN PATENT DOCUMENTS

| | | | |
|---|---|---|---|
| 40-8150229 | 6/1996 | Japan | 273/167 G |

*Primary Examiner*—Sebastiano Passaniti
*Attorney, Agent, or Firm*—Aquilino & Welsh

[57] ABSTRACT

The golf club of the present invention provides a club head wherein a shaft is bent so as to be directly insertable into the ball striking face adjacent the heel, thereby eliminating totally the need for a shaft hosel. The shaft may enter the club face at various locations and the bend of the shaft will vary between a minimum of five degrees to a maximum of 180 degrees depending, in part, on the loft angle of the particular club head. The hosel-less design of the present club provides slightly less wind resistance and theer is less mass to get tangled in grass when hitting from rough areas.

10 Claims, 6 Drawing Sheets

FIG. 1
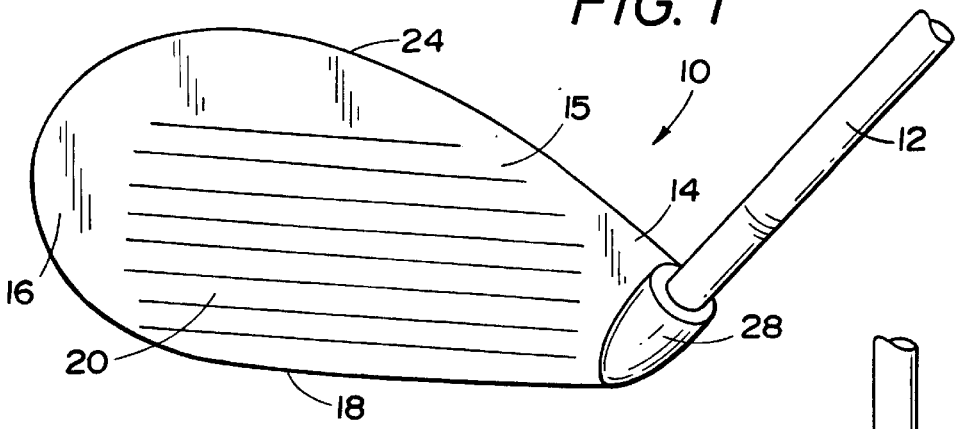
FIG. 2
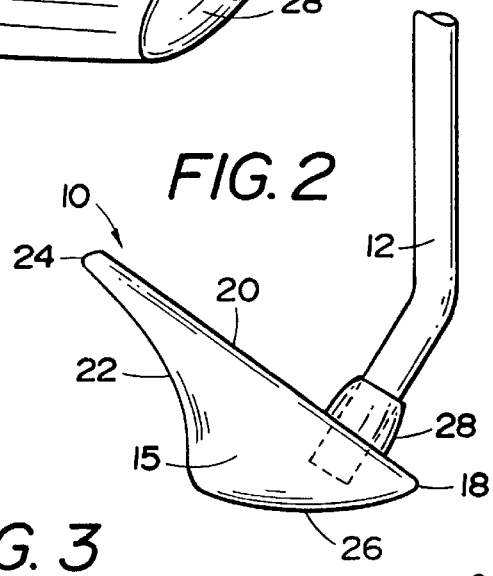
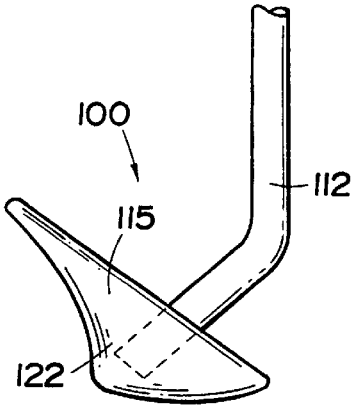
FIG. 4
FIG. 3
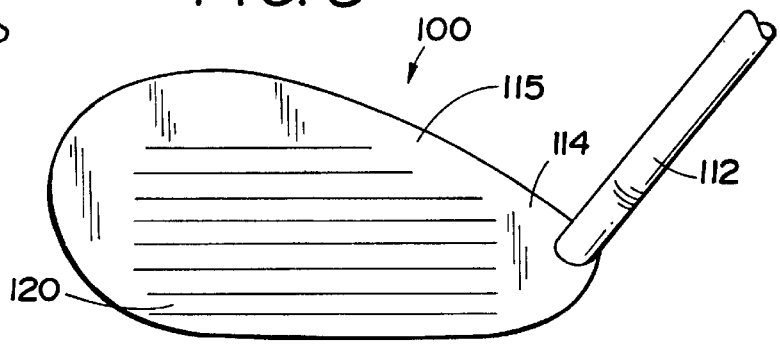
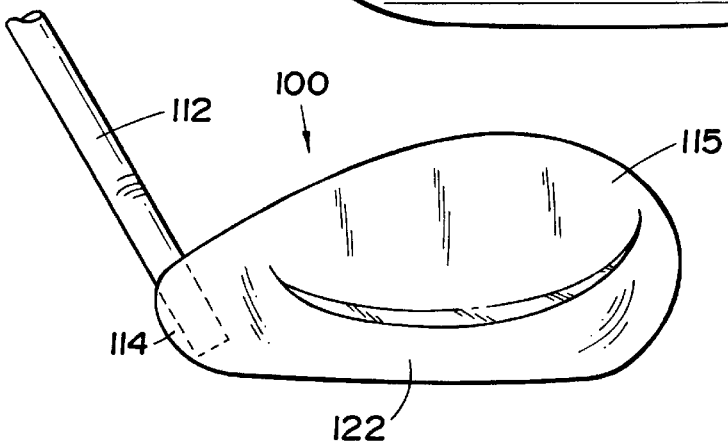
FIG. 5

FIG. 6
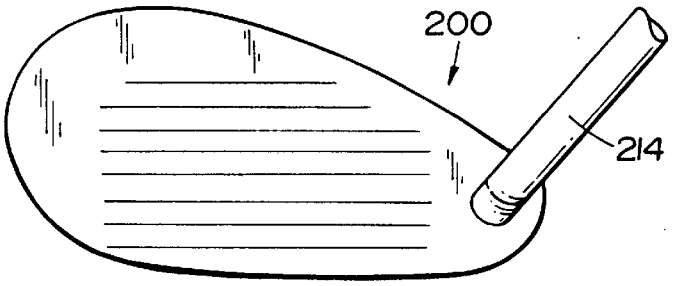
FIG. 7
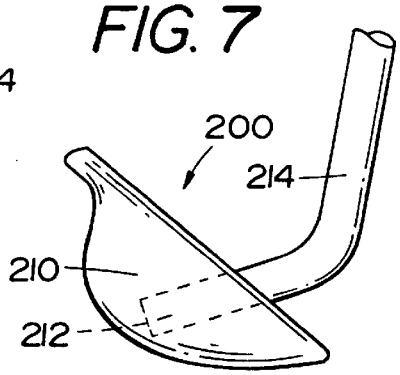
FIG. 8
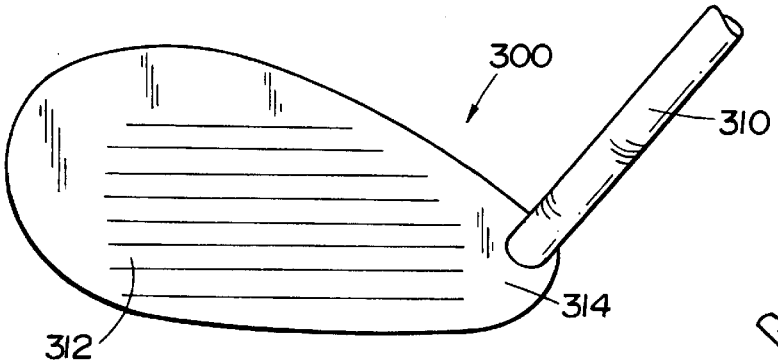
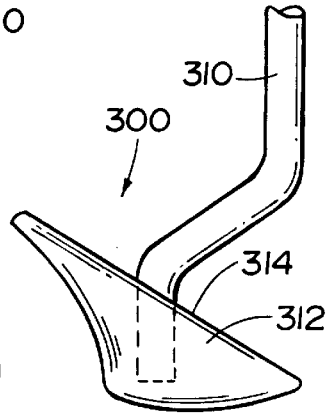
FIG. 9
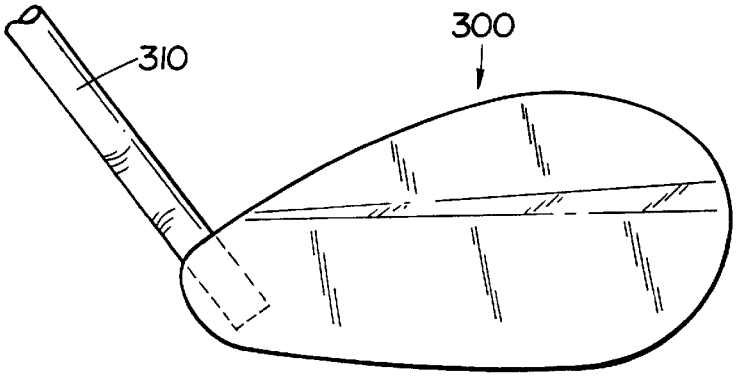
FIG. 10

HOSEL-LESS GOLF CLUB WITH A SINGLE BENT SHAFT

BACKGROUND AND SUMMARY OF THE INVENTION

The present invention relates to iron type golf club heads, and in particular, to a hosel-less type iron club with a bent shaft attached directly to the ball striking face.

It has been known in the prior art that removing weight from the hosel area of a golf club head and repositioning that weight elsewhere is beneficial to the performance of a golf club. A number of commercially available golf clubs eliminate some or most of the hosel altogether. All of this prior art, however, other than putters, use a standard type, straight shaft inserted into the top of the iron or wood type club head. With the hosel removed from these type of clubs, the insertion area or bore hole depth is very shallow which causes adhesion problems. A straight shaft on a hosel-less type club head presents visual problems to a golfer due to a lack of offset. For this reason, the so-called hosel-less irons actually have a small hosel that serves to hold the shaft and create the desired offset the golfer is looking for.

The prior art does not show the use of a bent shaft, particularly a single bend shaft, inserted directly into the club face to create a truly hosel-less iron or wood type golf club. Some putters have a single bend shaft used to create all or some of the offset, loft and lie. Such putters using various compound angles, usually conform with the United States Golf Assn Rules of Golf since the shaft may be attached at any point on the putter head. The rules for irons and woods require that the shaft must be attached at the heel of the club head so that when seen from the face view, the shaft axis is straight and the heel of the club head is no more than 0.625 inches off of the center line of the shaft axis. Any bend or offset seen from the toe view must not extend above five inches when measured from the sole of the club head along the axis of the shaft or hosel.

Referring to the prior art, hosel-less golf clubs are well known. In addition, U.S. Pat. No. D 303,132 to Muta shows a golf club head having a hosel which is connected to the front face of the club head and which extends upwardly with a single bend. U.S. Pat. No. 5,508,235 to Mendenhall shows a putter type golf club head wherein the hosel is connected directly to the ball striking face. U.S. Pat. No. 5,042,806 to Helmstetter shows a hosel-less a club head used with a straight shaft which is connected through to the sole of the club head.

The present invention conforms to all the current U. S. G. A. Rules of Golf for woods and irons while eliminating the weight used in hosels of conventional golf club designs. The shaft of the present invention may be bent in conjunction with the angle of the bore hole so that it enters the club head which has sufficient thickness to achieve an adequate bore depth for proper adhesion strength. This may be achieved using molded composite shafts with bends. Reinforced tips may be also provided on steel shafts, or shafts made of other materials, that will withstand the stress of a golf club hitting a ball and/or the ground without the bend being deformed. With this structure, the bulky hosel is entirely eliminated, thereby shifting the center of gravity to a lower position on the clubhead, making the club easier to swing.

The hosel-less design also provides slightly less wind resistance and there is less mass to get tangled in grass when hitting from rough areas. The present invention contemplates attaching the shaft with a bend directly to the club face using a small shaft receptacle or connecting the shaft directly into the club face without the receptacle.

The shaft may enter the club face at various locations and the bend of the shaft will vary between a minimum of five degrees to a maximum of 180 degrees depending, in part, on the loft angle of the particular club head. One embodiment also contemplates using a shaft with a plurality of bends to insure maximum depth of penetration of the shaft into the club head body.

Among the objects of the present invention is the provision of a golf club head with a shaft connected directly to the club face.

Another object is the provision of a golf club head wherein the entire weight of the club head is located adjacent the ball striking face.

Still another object of the present invention is the provision of a golf club head which is less bulky at the shaft-to-club head connection enabling the club to be swung through heavy grass or rough with relative ease.

Still another object of the present invention is the provision of a golf club head having a more strategic and efficient location of the overall weight of the club head.

Other objects and advantages of the present invention will become apparent from the following detailed description when viewed in conjunction with the accompanying drawings, which set forth certain embodiments of the invention.

BRIEF DESCRIPTION OF THE DRAWINGS

FIG. 1 shows a front elevational view of a first embodiment of a golf club head in accordance with the present invention.

FIG. 2 is a toe end elevational view of the club head of FIG. 1.

FIG. 3 is a front elevational view of a second embodiment of a golf club head in accordance with the present invention.

FIG. 4 is a toe end elevational view of the club head of FIG. 3.

FIG. 5 is a rear elevational view of the club head of FIG. 3.

FIG. 6 is a front elevational view of a third embodiment of a golf club head in accordance with the present invention.

FIG. 7 is a toe end elevational view of the club head of FIG. 6.

FIG. 8 is a front elevational view of a fourth embodiment of a club head in accordance with the present invention.

FIG. 9 is a toe end elevational view of the club head of FIG. 8.

FIG. 10 is a rear elevational view of the club head of FIG. 8.

DESCRIPTION OF THE PREFERRED EMBODIMENTS

Figure 11:
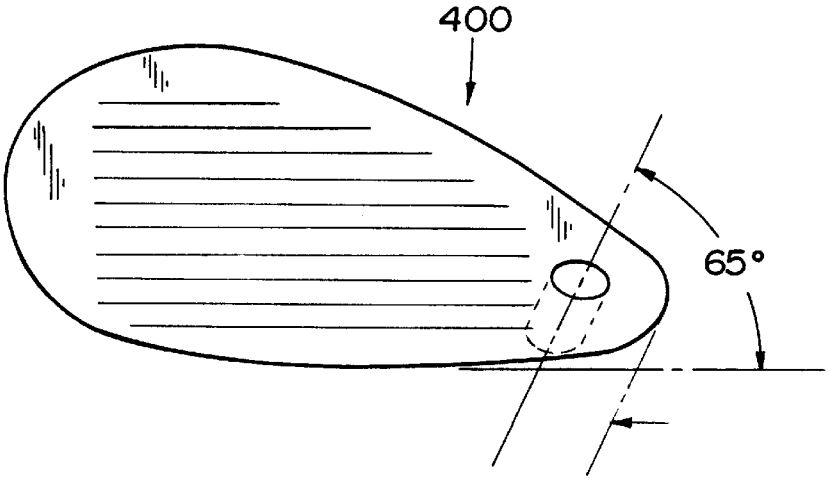
FIG. 11 is a front elevational view of a golf club head in accordance with the present invention.

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

The structural design of the hosel of the present invention creates a system which provides cushioning, reduces vibration and shock, and increases club head stability as well as overall weight distribution is disclosed. It is particularly adaptable for iron type golf clubs, allowing all the weight of the hosel to be redistributed directly into the club head body directly behind and near to the ball striking face.

Referring to the drawings, FIGS. 1 and 2 show a first embodiment of an iron type golf club 10 in accordance with the present invention. The golf club 10 includes a shaft 12 shown broken away which is connected to a handle, or grip, (not shown). The golf club 10 is of conventional shape formed of a club head body 15 including a heel 14, a toe 16, leading edge 18, ball striking face 20, rear surface 22, top ridge 24 and bottom sole 26. As shown in FIG. 2, the shaft 12 is bent approximately 30° into a shaft receptacle 28 mounted at the heel 14 of the ball striking face 20. The offset or bend of the shaft 12, as seen from the toe view, does not extend above five inches when measured from the sole of the club head along the axis of the shaft. It will be appreciated that the club head 10 shown is a wedge type, having approximately a 60° loft. As best seen in FIG. 1, the shaft is attached to the heel of the club head so that when seen from the face view, the shaft axis is straight and the heel of the club head is no more than 0.625 inches off of the center line of the shaft axis. Since the invention is equally applicable for lower lofted irons, it will be appreciated that the bend in the shaft angle will be such to accommodate an insertion of the end of the shaft into a shaft receptacle at an angle between 5 degrees and 180 degrees to the ball striking face.

As can be seen with reference to FIG. 2, the lower end of the club head body 15 is relatively thick because the weight from the hosel has been repositioned in this area. This allows for better adhesion of the shaft 12 when it is connected into the club head body 15. This solid connection is maintained not withstanding the impact forces on the golf club 10 by repeated striking of a golf ball and against the ground surface during the execution of golf shots.

Thus it can be seen that the improved golf club of the present invention provides a club head wherein a shaft is bent so as to be directly insertable into the ball striking face adjacent the heel, thereby eliminating totally the need for a shaft hosel. The overall weight of the club head may be made the same enabling the weight of the hosel to be shifted into the club head body, closer to the ball striking face, providing a more solid impact area for a given execution of force during a swing.

FIGS. 3, 4 and 5 show a second embodiment of a golf club 100 in accordance with the present invention, including a club head body 115 which is essentially the same as the embodiments in FIGS. 1 and 2, except that a shaft 112 is connected directly into the ball striking face 120. In this embodiment, the shaft 112 is located further up on the ball striking face toward a thicker portion of the club head body 115, thereby eliminating the need for a shaft receptacle. The shaft 112 is bent at an angle to facilitate the connection to the club head body 115. The club head body 100 is thicker across the lower, rear portion 122 of the club head body 115, because of the weight relocated from above the heel 114 where a hosel would normally be located. This enables a bore hole to be drilled to a sufficient depth to allow a sufficient length of the shaft 112 to enter the club head body 115 to create the necessary amount of interior adhesion surface for strong shaft bonding.

FIGS. 6, and 7 show a third embodiment of a golf club head 200. In this embodiment, the rear 210 of the club head is shown to be thicker and thus may be made of lighter weight material, such as, titanium, aluminum, or graphite, among other materials, in combination with a hollow steel shell type head to create a deeper back configuration. This structure allows for deeper penetration of the end 212 of a shaft 214 into the club head 200.

FIGS. 8, 9 and 10 show a golf club 300 having a double bend shaft 310 inserted directly into a club head body 312 through the ball striking face 314. When viewed from the front (FIG. 8) the shaft 310 is in a straight line along the longitudinal axis.

Figure 12:
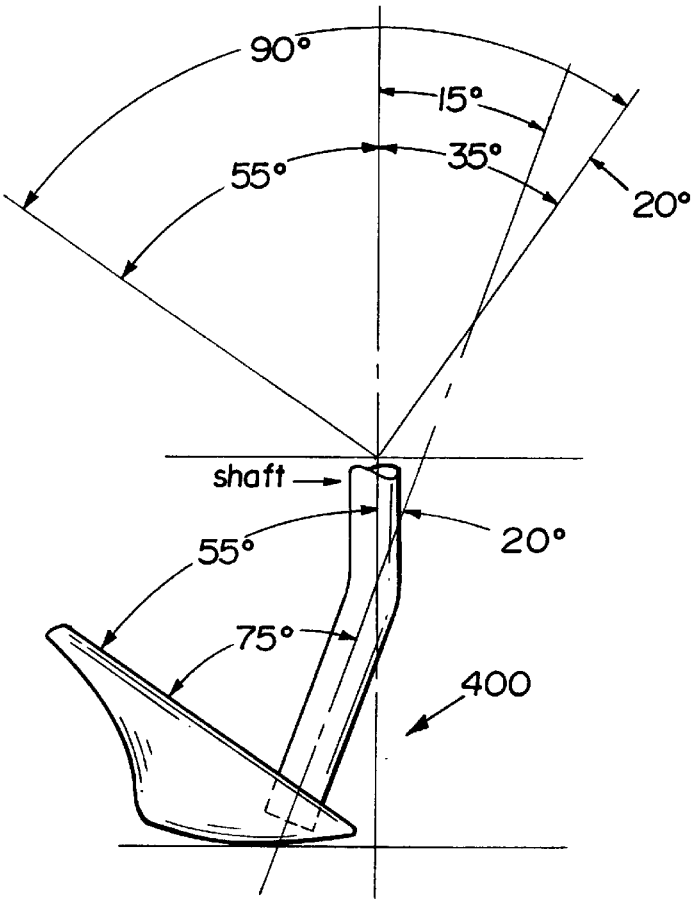
FIG. 12 is a toe end elevational view of the club head of FIG. 11.

FIGS. 11 and 12 show a golf club head 400 using the bore angles required to make a 55° loft wedge type iron with a 65° lie with a 20° single bend shaft.

Figure 13:
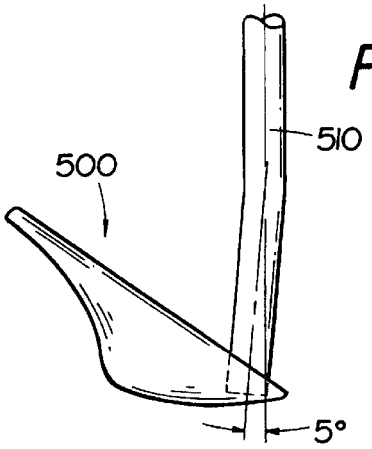
FIG. 13 shows a golf club having a shaft with a single bend at a first angle.
Figure 14:
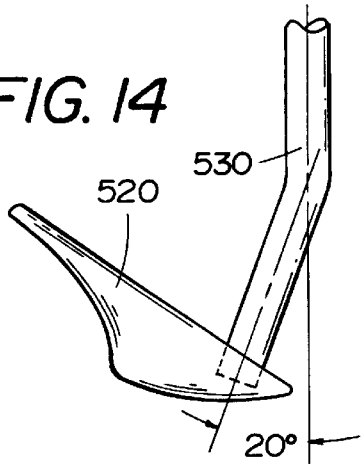
FIG. 14 shows a golf club having a shaft with a single bend at a second angle.
Figure 15:
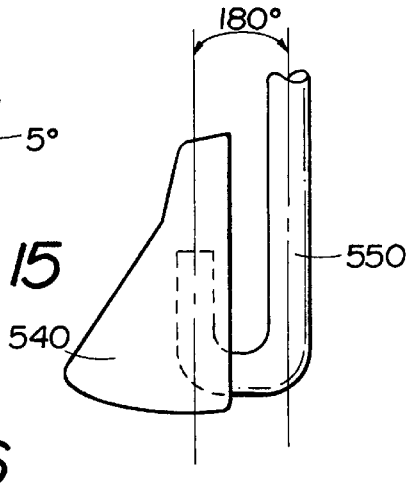
FIG. 15 shows a golf club having a shaft with a single bend at a third angle.

FIG. 13 shows a golf club 500 having a shaft 510 with a single bend at an angle of approximately 5 degrees. FIG. 14 shows a golf club 520 having a shaft 530 with a single bend at an angle of approximately 20 degrees. FIG. 15 shows a golf club 540 having a shaft 550 with a single bend at an angle of approximately 180 degrees. It will be appreciated that the shaft bend angle may be between a minimum of 5 degrees and a maximum of 180 degrees, depending upon the loft angle of the club head to which it is attached.

Figure 16:
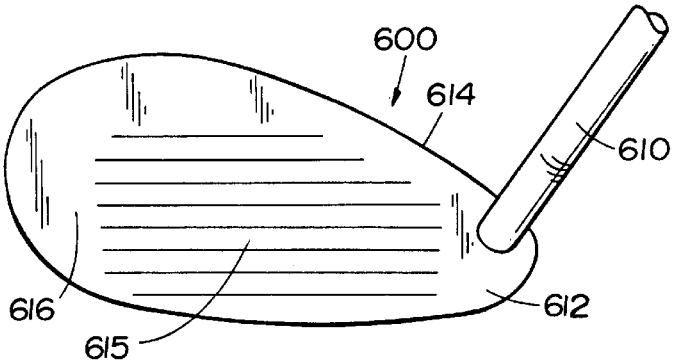
FIG. 16 is a front elevational view of another embodiment of an iron type golf club head in accordance with the present invention.
Figure 17:
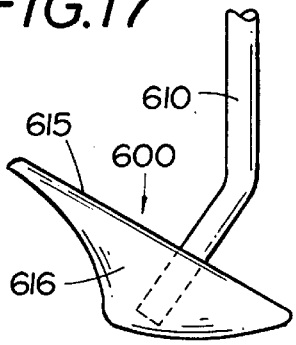
FIG. 17 is an end elevational view of the club of FIG. 16.
Figure 18:
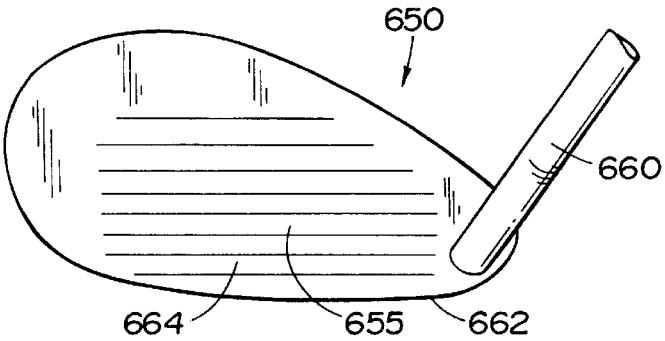
FIG. 18 is a front elevational view of still another embodiment of an iron type golf club head in accordance with the present invention.
Figure 19:
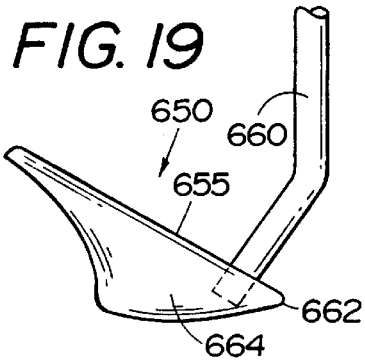
FIG. 19 is an end elevational view of the club head of FIG. 18.

FIGS. 16 and 17 show a golf club 600 wherein the shaft 610 is mounted high on the heel 612 of the club face 615 near the top ridge 614 of the club head body 616. FIGS. 18 and 19 show a golf club 650 wherein the shaft 660 is mount low on the club face 655 adjacent the leading edge 662 of the club head body 664.

Figure 21:
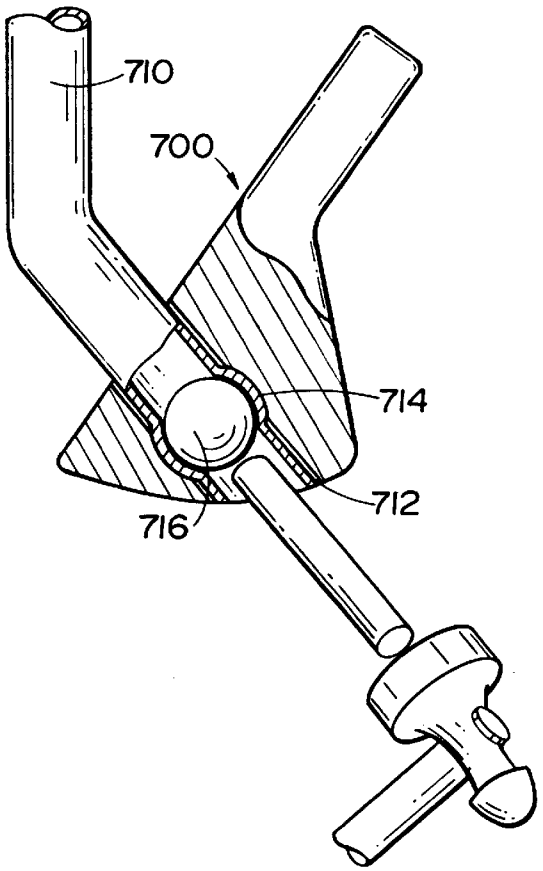
FIG. 21 is a side elevational view showing a preferred manner of inserting the connector into the golf club.
Figure 20:
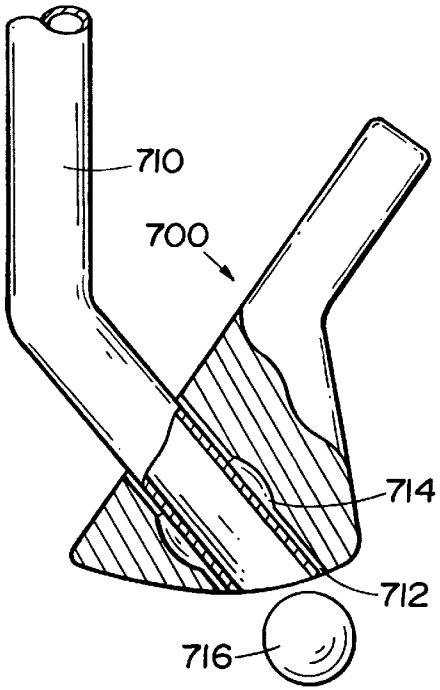
FIG. 20 is a side elevational view partly in section showing a golf club head and connector therefor.

FIGS. 20 and 21 show a preferred method of attaching a shaft 710 to a club head 700. A bore hole 712 includes a recess 714 having a slightly smaller diameter than a ball bearing 716. After the shaft 710 is inserted into the bore hole 712, the ball bearing is driven into the shaft opening by a mallet and rod until it seats opposite the recess 714. When the parts are properly sized the ball bearing will cause the shaft 710 to slightly expand into the recess, preventing further movement of the shaft 710 in the bore hole 712.

Figure 23:
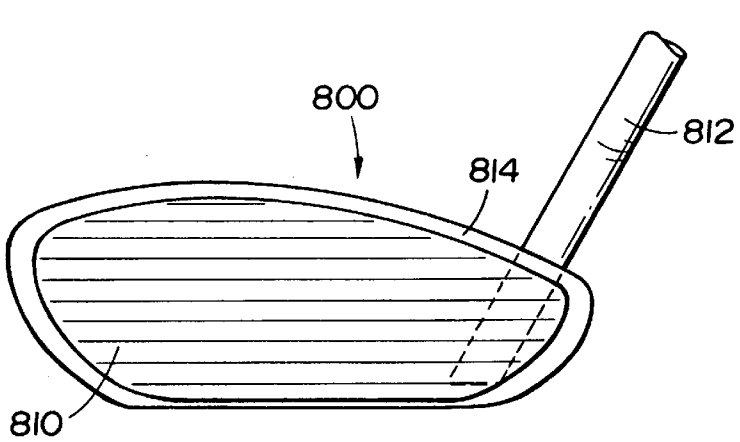
FIG. 23 is a front elevational view of the club head of FIG. 22.
Figure 22:
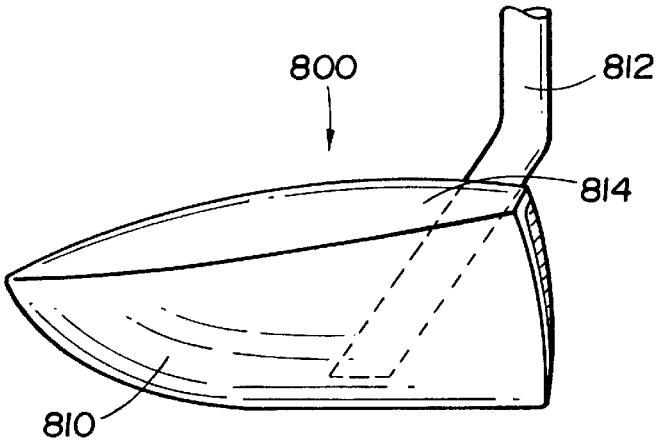
FIG. 22 is a side elevational view of a wood type golf club head in accordance with the present invention.

FIGS. 22 and 23 show a wood type golf club 800 including a club head body 810 and a shaft 812 which includes a single bend and which is inserted into the top surface 814 of the club head body 810. This structure requires no hosel or shaft collar.

Figure 25:
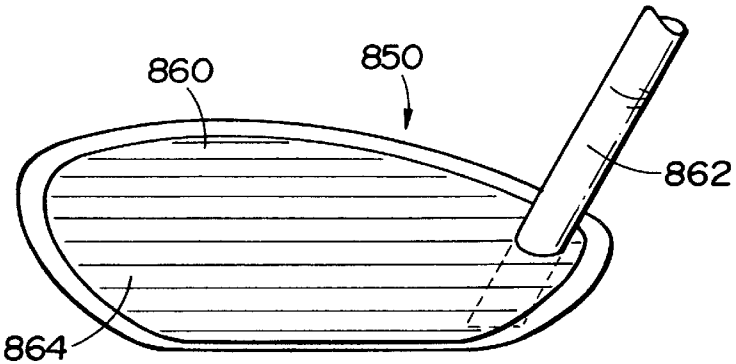
FIG. 25 is a front elevational view of the wood type golf club head of FIG. 24.
Figure 24:
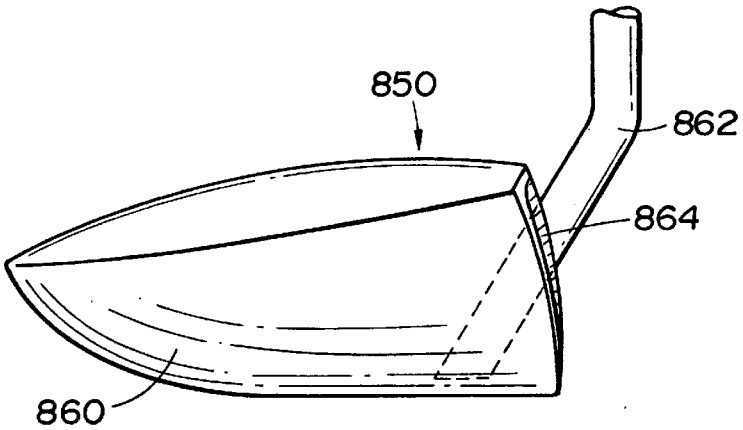
FIG. 24 is a side elevational view of a second embodiment of a wood type golf club head in accordance with the present invention.

FIGS. 24 and 25 show a wood type golf club 850 including a club head body 860 and a shaft 862 which includes a single bend and which is inserted directly into the ball striking face 864 of the club head body 850.

The detailed embodiments of the present invention are disclosed herein. It should be understood, however, that the disclosed embodiments are merely exemplary of the invention which may be embodied in various forms. It will be apparent to those skilled in the art that various modifications and variations may be made in the hosel-less golf club head of the present invention without departing from the spirit and scope of the invention. Therefore, the details disclosed herein are not to be interpreted as limiting, but merely as a basis for claims and a basis for teaching one skilled in the art how to make and/or use the invention. It is intended that the present invention cover the modifications and variations of this invention provided they come within the scope of the appended claims and their equivalents.

I claim:

1. A hosel-less iron type golf club head including a hosel-less club head body having a loft angle of at least 12 degrees, a heel, toe, ball striking face, top ridge, bottom surface and rear surface wherein the improvement comprises:

a golf club shaft connected adjacent said heel on said club head body having a tip section formed with at least one bend; said shaft having a longitudinal axis lying in a straight line when viewed from said ball striking face; said bend being at an angle of at least 5 degrees and less than 90 degrees with the longitudinal axis of said shaft when viewed from said toe;

said bend of said shaft creating an offset between the front edge of said shaft and the leading edge of said club head body;

said tip section being connected directly to the ball striking face adjacent to and spaced from said heel of said club head body.

2. The golf club of claim 1, further including a shaft receptacle mounted on said ball striking face, said shaft being located in said shaft receptacle.

3. The golf club of claim 1 being further defined by said shaft being connected adjacent said top surface of said club head.

4. The golf club of claim 1 being further defined by said shaft being connected adjacent said bottom surface of said club head.

5. The golf club of claim 1 being further defined by said shaft being connected perpendicular to said ball striking face.

6. The golf club of claim 1 being further defined by said shaft having at least two bends.

7. The golf club of claim 1 wherein said tip section connected directly to said ball striking face has a length not exceeding five inches.

8. The golf club head of claim 1 wherein a centerline of said tip section is spaced from the heel at a distance not exceeding 0.625 inch.

9. A wood type golf club including a hosel-less club head body having, a heel, toe, ball striking face, top surface, bottom surface and rear surface wherein the improvement comprises:

a golf club shaft connected adjacent said heel on said club head body having a tip section formed with at least one bend; said shaft having a longitudinal axis lying in a straight line when viewed from said ball striking face; said bend being at an angle of at least 5 degrees and less than 90 degrees with the longitudinal axis of said shaft when viewed from said toe;

said bend of said shaft creating an offset between the front edge of said shaft and the leading edge of said club head body;

said tip section being connected directly to the ball striking face adjacent to and spaced from said heel of said club head body.

10. The golf club head of claim 9 wherein a centerline of said tip section is spaced from the heel at a distance not exceeding 0.625 inch.

* * * * *